US006052144A

United States Patent [19]

Reyner

[11] Patent Number: 6,052,144

[45] Date of Patent: Apr. 18, 2000

[54] IMAGE PRINTING

[75] Inventor: Noel L. Reyner, Hilton, N.Y.

[73] Assignee: Eastman Kodak Company, Rochester, N.Y.

[21] Appl. No.: 09/088,105

[22] Filed: Jun. 1, 1998

[51] Int. Cl.[7] ..... B41J 15/16

[52] U.S. Cl. ..... 347/262; 347/264; 347/154; 347/136; 400/500

[58] Field of Search ..... 346/136; 347/262, 347/264, 154; 396/570; 226/42; 400/500, 583; 242/412.2, 412.3

[56] References Cited

U.S. PATENT DOCUMENTS

| | | | |
|---|---|---|---|
| 4,172,659 | 10/1979 | Laska | 355/68 |
| 4,286,868 | 9/1981 | Laska | 355/68 |
| 4,348,118 | 9/1982 | Shafvenstedt et al. | 400/54 |
| 4,384,665 | 5/1983 | Waddington | 226/42 |
| 4,567,492 | 1/1986 | Skafvenstedt et al. | 346/136 |
| 4,629,177 | 12/1986 | Roddeman et al. | 271/240 |
| 4,663,638 | 5/1987 | Hirose | 346/136 |
| 4,734,868 | 3/1988 | DeLacy | 395/111 |
| 4,837,636 | 6/1989 | Daniele et al. | 358/300 |
| 4,863,085 | 9/1989 | Takenouchi et al. | 226/92 |
| 4,878,067 | 10/1989 | Yagoto et al. | 347/262 |
| 5,079,569 | 1/1992 | Bunch, Jr. | 346/136 |
| 5,107,296 | 4/1992 | Ozawa et al. | 355/28 |
| 5,377,589 | 1/1995 | Kruger et al. | 101/248 |
| 5,546,993 | 8/1996 | Summey, III et al. | 139/311 |
| 5,564,845 | 10/1996 | Yamaguchi et al. | 400/582 |
| 5,585,879 | 12/1996 | Tahara et al. | 396/570 |

*Primary Examiner*—N. Le
*Assistant Examiner*—Hai C. Pham
*Attorney, Agent, or Firm*—Gordon M. Stewart; David A. Novais

[57] ABSTRACT

A printer to print images on a continuous web. The printer has a print station at which the images are printed on the web. A web transport transports the web in a lengthwise direction through the print station. The web transport including a slack loop station having a web feeder and a web receiver. These are spaced apart from one another to transport a web in the lengthwise direction while establishing a web slack loop therebetween which extends in a first direction. The web transport also includes a web proximity sensor which is directed along the first direction to measure a distance between the sensor and the slack loop. A method of printing images on a continuous web is also provided.

32 Claims, 2 Drawing Sheets

IMAGE PRINTING

FIELD OF THE INVENTION

The present invention relates to printing images, and in particular relates to images which are printed line by line.

BACKGROUND OF THE INVENTION

In conventional high volume photofinishing, a photoprocessor receives exposed undeveloped film. This film is chemically developed at the photoprocessor and the developed images are then printed optically at a printing station from onto a photosensitive paper web, one complete frame at a time. The web is transported in a lengthwise direction from an input cassette, past the printing station and into an output cassette, pausing at the print station for a sufficient time to allow exposure of one image frame after another from the negative onto sequential locations on the web. The drive mechanism for the web has previously been designed to cause it to form a slack loop immediately before and after the print station. These slack loops act as buffers, allowing the drive mechanism to continuously withdraw the web from the input cassette and feed it into the output cassette without interruption despite the pausing of the web at the print station. Incorrect positioning of the web at the print station is usually not critical since some small space is allowed for in the lengthwise direction of the web, between printed images for later cutting. Thus, any slight error in positioning of the web at the print station typically only causes the size of this space to vary somewhat. The size of each slack loop has been monitored by a dual emitter/detector system. In such a system an optical or acoustic emitter is positioned to direct a beam perpendicular to the direction in which the slack loop extends, with a corresponding optical or acoustical detector being positioned at the other side of the loop to receive the beam. Two such emitter/detector sets are provided, each spaced from the other in the direction in which the slack loop extends. Such a configuration is illustrated, for example, by loop detector 6 in U.S. Pat. No. 4,878,067 which uses a light emitter (although acoustic emitters have also been previously used in place of the light emitters).

It has been recently suggested that photofinishers adopt a digital environment in which developed images on the films are scanned to yield corresponding digital images, or digitally captured images are received from digital cameras or remote scanners. These digital images are then subjected to any desired digital image processing, and the resulting digital images are printed by a digital printer, such as a laser printer. Laser printers use a rotating platen over which a photographic paper web can pass, with the laser printing by scanning one line at a time in a direction across the web. Continuous movement of the paper at a precise velocity in the lengthwise direction of the web, provides for scanning in the other direction (that is, in the lengthwise direction of the web). A simple laser printer configuration with slack loops, is also illustrated in U.S. Pat. No. 4,878,067. However, the present invention recognizes that the size of the slack loops is not known with much precision, since the loop detector can only tell that the most extreme portion of the slack loop (the loop "meniscus") is somewhere between the two beams. The present invention further recognizes that in the case of a laser printer or other line by line printer, the need for precise movement of the web is particularly critical. In the case where slack loops on either side of the print station vary in size, this leads to variable and unequal web weights which in turn can cause minor variations in the advancing of the web through the print station. Further, the present invention recognizes that in printing images in particular, the widths of the web might change. This may require the size of the slack loops to be adjusted. However, the present invention further realizes that with the type of slack loop detector system in U.S. Pat. No. 4,878,067, there is no easy way to reconfigure the printer for substantially different sized slack loops without physically moving the location of the entire slack loop detector system.

It would be desirable then, if a slack loop detector in a web transport of an image printer, could be provided which accurately tracks the size of the slack loop. Such accurate detection would be particularly important in a laser printer or other line by line printer where the web should be precisely advanced past the print station. Further, it would be desirable if a means can be provided which allows the slack loop detector to readily detect slack loops of various sizes without cumbersome repositioning of the detector or its components.

SUMMARY OF THE INVENTION

The present invention has recognized the difficulties with slack loop detectors of the type disclosed in U.S. Pat. No. 4,878,067, particularly in relation to line by line printers, as discussed above. The present invention then, provides a printer to print images on a continuous web. The printer has a print station at which the images are printed on the web. A web transport of the printer transports the web in a lengthwise direction through the print station. The web transport includes a slack loop station having a web feeder and a web receiver, spaced apart from one another to transport a web in the lengthwise direction while establishing a web slack loop therebetween which extends in a first direction. The web transport further has a web proximity sensor directed along the first direction to measure a distance between the sensor and the slack loop.

The present invention provides, in another aspect, a printer of the above type wherein the print station has a print head to write the image line by line on the web at a printing position. The print station of this aspect further has a driver to advance the web in synchronization with line printing by the print head. Preferably this advancement is done continuously. Thus, when the print head has finished printing one line, the web has been advanced a distance of about one line. In this aspect, the slack loop station can be located anywhere along the web transport but may particularly be located on an input side or an output side of the print station.

In another aspect of the present invention, there is provided a printer to print images on a continuous web having a print station and a web transport. The print station has a print platen, and a print head to write the image line by line on the web at a printing position on the print platen. The web transport transports the web in a lengthwise direction through the print station, in synchronization with line printing by the print head. The web transport includes a slack loop station on an input side and a slack loop station on an output side of the print station. Each slack loop station is of the configuration described above. In this aspect of the invention, the print platen acts as the web receiver for the slack loop station on the input side of the print station, and acts as the web feeder for the slack loop station on the output side of the print station.

The proximity sensor can be of various types suitable for use with the web, but is preferably an acoustic sensor since when photosensitive webs are used, they will not risk exposure from the sensor. While the proximity sensor could be directed in different directions, for example in the same direction as the slack loop extends (so that it is pointing toward an inside of the slack loop), it is preferred that it is directed back along the first direction (so that it is pointing toward an outside of the meniscus of the slack loop). In a typical printer, the feeder and receiver will be configured to cause the slack loop to extend in a downward direction during normal operation of the printer, while the proximity sensor is directed upward.

In another aspect of the present invention, the slack loop station additionally comprises a baffle oriented in the first direction so as to restrain movement of a meniscus of the slack loop in a direction tangential to the meniscus. This could be positioned to be adjacent an outside surface of the slack loop, and toward the web feeder or web receiver of the slack loop station, but is preferably positioned to be adjacent the inside surface of the slack loop and on the feeder side.

A still further aspect of the present invention provides a method of printing images on a continuous web. In this method the images are printed on the web at a print station. The web is transported in a lengthwise direction through the print station, while a slack loop is formed in the web transport path which slack loop extends in a first direction, and a distance which the slack loop extends in the first direction is measured using a beam directed along the first direction.

Different aspects of the present invention can provide one or more of the following advantages or other advantages which will be appreciated from the present application. Namely, the size of the slack loop in a printer can be fairly accurately tracked. This accurate tracking allows for accurate movement of the web during a line by line printing operation. Additionally, slack loops of various sizes can be readily tracked without a need for repositioning hardware of the detector. This facilitates changing a desired slack loop size to accommodate different web widths.

BRIEF DESCRIPTION OF THE DRAWINGS

Embodiments of the invention will now be described with reference to the drawings, in which.

Like reference numbers are used in the different drawings to represent the same parts, where possible.

DETAILED DESCRIPTION OF THE INVENTION

Figure 1:
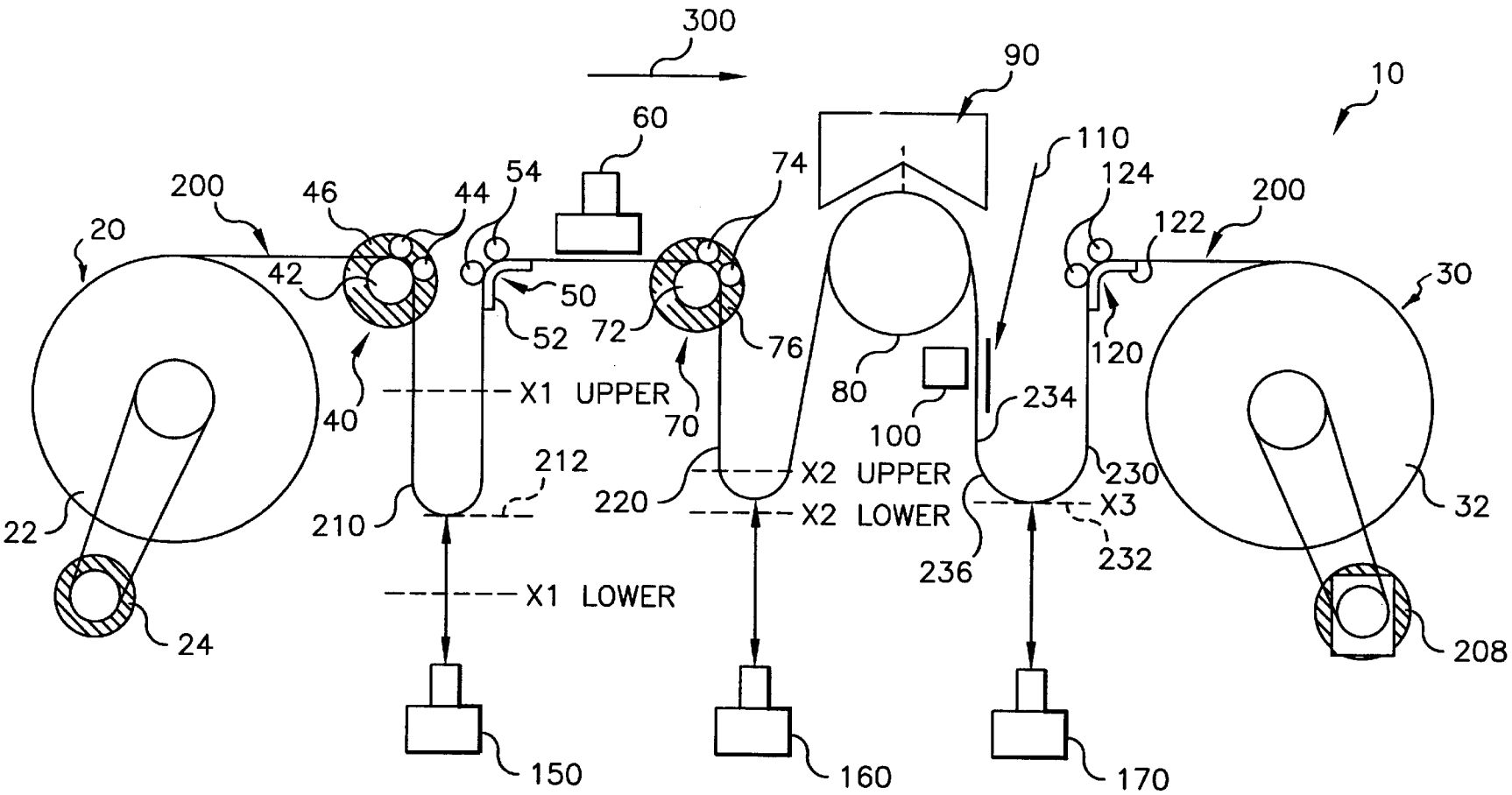
FIG. 1 is a schematic view of an image printer of the present invention.

Referring to the drawings, an image printer 10 is provided to print digital photographic images on a continuous web 200 of photosensitive paper. Web 200 may, for example, be suitable photographic paper with the photosensitive front side facing upward as viewed in the drawings, as web 200 exits a supply cassette 20 as shown in the drawings. The printer includes a print station which includes a laser print head 90 and a rotatable cylindrical print platen 80. Print head 90 receives image signals from a suitable source of digital image information, such as a digital computer having access to a memory storing the digital images to be printed. Such digital images may be obtained from previously scanning photographic film or prints developed at the same or a remote location from printer 10, or from some medium (for example, a magnetic or optical disk, a digital camera or remote scanner) carrying the digital images. Alternatively, digital images may, for example, be obtained from a remote site over a suitable communication channel (for example, the Internet, a telephone or other network, and including optical, wire satellite or other digital signal transmission means). Print head 90, under control of the computer, prints a single line of the image in a direction across web 200. Simultaneously with this, web 200 is advanced continuously at a precise rate in preparation for print head 90 to write the next line of the image, and so on until an entire image is printed. Printer 10 is intended to be used with the removable supply cassette 20 carrying a roll 22 of photosensitive photographic paper, and with a removable take-up cassette 30 onto which exposed photosensitive paper is wound in a roll 32.

A web transport is provided to transport the photosensitive web 200 from the supply cassette 20, continuously through the print station in synchronization with line printing by print head 90, and out to the take-up cassette 30. A motor (not shown) is provided to rotate platen 80 continuously at a precise rate. Additional components of the web transport include a first web feeder 40 and first web receiver 50, a second web feeder 70 and a rotatable platen 80 which acts as a second web receiver, rotating platen 80 again which acts as a third web feeder, and a third web receiver 120. First web feeder 40 includes a cylindrical roller 42 driven by motor 46 and two idler rollers 44. Similarly, first web receiver 50 includes a curved guide plate 52 and two rollers 54, while second web feeder 70 includes cylindrical roller 72 driven by motor 76 and two idler rollers 74. As already mentioned, cylindrical rotatable platen 80 acts as the second web receiver and the third web feeder. Third web receiver 120 includes a curved guide plate 122 and two idler rollers 124. The web transport further includes a motor 208 to rotate roll 32 to take up web 200 into take-up cassette 30.

The web transport of the embodiment in the drawings, has three slack loop stations which include one of the web feeders and the corresponding web receiver, as well as an acoustic proximity sensor 150, 160, 170. In particular, a first slack loop station includes first web feeder 40, acoustic proximity sensor 150 and web receiver 50. A second slack loop station includes second slack loop feeder 70, acoustic proximity sensor 160, and print platen 80 which acts as the second slack loop receiver. A third slack loop station includes print platen 80 which acts as a third slack loop feeder, acoustic proximity sensor 170, and third slack loop receiver 120. Note that the rollers (or guide plate) of each slack loop station are arranged to transport the web 200 in the lengthwise direction as indicated by arrow 300 while establishing a slack loop of the web between the feeder and receiver of each station. Thus, during operation of the web transport, first, second, and third slack loop stations establish first slack loop 210, second slack loop 220, and third slack loop 230, respectively. Each of slack loops 210, 220, 230 extend in a first direction, which in normal operation of printer 10 is in the downward direction (which is also shown as the downward direction as viewed in the drawings). The meniscus of a slack loop is the lowest part of the slack loop and extends in a direction into and out of the page in FIGS. 1 and 2. A direction tangential to the meniscus of a slack loop extends to the left and right as viewed in FIGS. 1 and 2 (for example, lines 212, 232 indicate such tangential directions). Each acoustic web proximity sensor 150, 160, 170 is directed along the first direction (which again is downward, in the embodiment of the drawings). "Directed along" does not necessarily mean that the proximity sensors 150, 160, 170 are directed generally in the same direction in which the loops extend, but includes the proximity sensors being directed (or facing) in a generally opposite direction. In the particular embodiment of the drawings, the proximity sensors are directed to face in a generally opposite direction than the direction in which the slack loops 210, 220, 230 will extend (that is, back along the first direction). That is, slack loops 210, 220, 230 extend downward while proximity sensors 150, 160, 170 are directed upward. Each acoustic proximity sensor 150, 160, 170 emits an acoustic beam in an upward direction (and hence are considered as being "directed" or "facing" upward), while receiving a reflection of the beam from the meniscus of the corresponding slack loop 210, 220, 230. The direction of the beam and its reflection are indicated in FIG. 1 by the double headed arrows between each acoustic proximity sensor and the meniscus of its corresponding slack loop.

Figure 2:
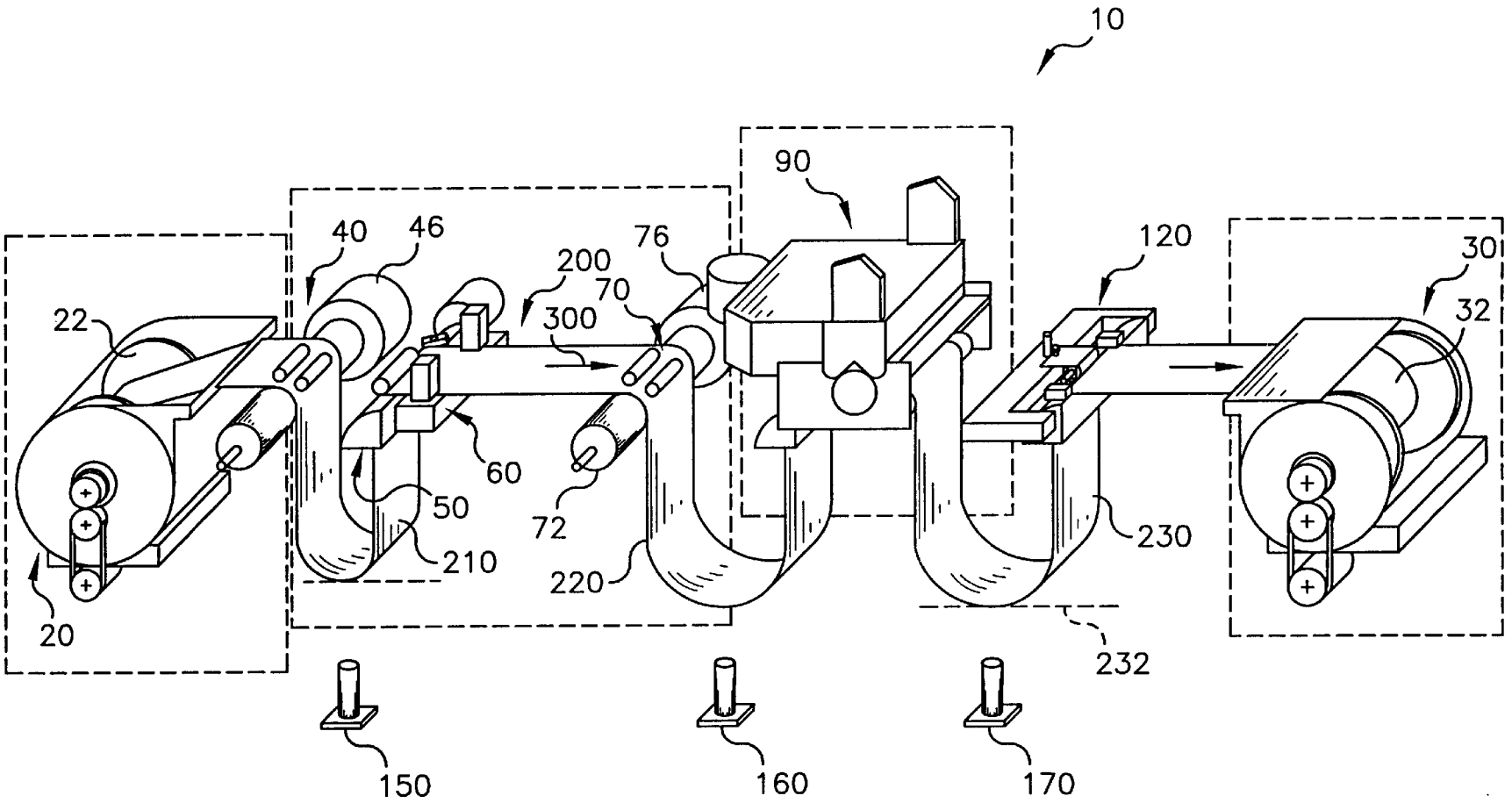
FIG. 2 is a perspective view of the image printer of FIG. 1.

The web transport further includes a baffle 110 (shown in FIG. 1 but not shown in FIG. 2 for clarity). Baffle or guide plate 110 is a generally rectangular plate positioned to be adjacent an inside surface 234 of slack loop 230 formed by the third slack loop station. Furthermore, as can be seen from FIG. 1, baffle 110 is positioned on a feeder side of slack loop 230 (the feeder side is the side of a slack loop which is closest to the web feeder of that slack loop station). Baffle 110 restrains movement of a meniscus of slack loop 230 in a direction tangential to the meniscus (this tangential direction being illustrated by broken line 232). Printer 10 also includes a code punch 60 which can punch codes in web 200 for various purposes (such as for later cutting of printed images on web 200 or positioning of web 200 within the print station). Furthermore, a secondary print head 100, which acts as a back printer, is positioned to be adjacent an outside surface of slack loop 236 in opposition to baffle or guide plate 110. Print head 100 is preferably an ink jet printer.

The operation of printer 10 will now be described. It will be assumed that cassettes 20 and 30 have been installed in printer 10. Web 200 is manually threaded through the path as illustrated in the drawings, by an operator. Optionally, it is not necessary for the operator to initially establish slack loops 210, 220, 230. The relative positions of the rollers 42, 44 in feeder 40, guide plate 52 and rollers 54 in receiver 50; rollers 72, 74 in feeder 70, and rollers 124 in relation to curved plate 122 in receiver 120, assist in forming and/or maintaining the respective slack loops 210, 220, 230 in the downward direction. Each acoustic proximity sensor 150, 160, 170 emits an acoustic beam, and senses the distance between it and the meniscus of its corresponding slack loop by sensing the time it takes for the reflection of its emitted acoustic beam to arrive back at the sensor. This information provides a fairly accurate indication of the size of the slack loop at any given time. The information from acoustic proximity sensors 150, 160, 170 is fed to a suitably programmed control processor (such as a suitably programmed computer circuit) which alternatively may take the form of hardware or hardware/software combinations performing the same functions. Motors 46, 76, 208, and the motor rotating cylindrical platen 80 are controlled by this control processor. The speed of these motors are controlled as necessary such that web 200 is fed lengthwise through the print station (specifically, past print head 90) while maintaining the size of the slack loops 210, 220, 230 fairly constant at respective predetermined values.

Motor 76 is briefly stopped between one set of images to another, to allow punch 60 to punch an encodement onto web 200. However motor 46 will generally be rotated continuously during operation of printer 10 since it is difficult to continuously start and stop rotation of web roll 22. Slack loop 210 then, acts as a buffer to allow intermittent motion of web 200 at punch 60 while allowing continuous withdrawal of web 200 from cassette 20. Thus, the size of slack loop 210 is not particularly critical and the predetermined size can be allowed by the control processor to vary over some substantial range, such as between X1 upper and X1 lower, as may be considered appropriate. Similarly, motor 208 will be operated substantially continuously (although speed may be varied somewhat) to cause continuous take-up of web 200 onto roll 32 in take-up cassette 30. On the other hand, the control processor is synchronized with the line by line writing of print head 90. With this synchronization the control processor controls the motor for platen 80 so as to continuously rotate platen 80 sufficient to advance the web one line past print head 90 between each line writing by print head 90. Thus, the movement of web 200 past print head 90 is isolated from movement of the web elsewhere in the web transport by slack loops 220 and 230, which act as web buffers.

It will be seen then, that precise control of the movement of web 200 past print head is important if each line of the image is to print in correct relation to the other. While the motor driving platen 80 is a brushless DC motor with very precise constant velocity, the exact distance which the web is advanced past print head 90 is to some extent dependent upon forces pulling at the web from an input and output side of the print station. Such forces are in turn dependent upon the size of the slack loops 220, 230. Thus, it is important to maintain the sizes of slack loops 220, 230 within fairly small predetermined ranges, such as range X2 upper and X2 lower for slack loop 220 and within a range defined by an area of line X3 for slack loop 230. If this is not done, the line spacing in the printed image will vary with resultant printed images of poor quality. Acoustic proximity sensors provide continuous information on the size of slack loops 220, 230 which the control processor uses to control the speed of motors 76 and 208 and/or the motor driving platen 80, to maintain the size of slack loops 220, 230 within fairly limited predetermined ranges. If the speed of rotation of platen 80 is varied, it will be appreciated that the control processor should also synchronize the line by line printing of print head to maintain synchronization with the transport of web 200 past print head 90. With such an arrangement both slack loops 220, 230 can be maintained within fairly narrow predetermined size ranges. Typically, these ranges will maintain the lengths of slack loops 220, 230 such that the total force exerted by each on the web 200 at print head 90 is substantially equal. Thus, movement of web 200 past print head 90 will not be substantially influenced by forces other than rotation of platen 80 by its drive motor.

In practice, when motor 208 is accelerated somewhat to adjust the size of slack loop 230, it has been found that slack loop 230 will tend to be pulled away from platen 80 in the direction of transport 300 of web 200 through the printer 10. This means that the meniscus of slack loop 230 is moved in a direction tangential to the meniscus (such tangential direction being indicated by line 232) in the direction of arrow 300. This causes acoustic sensor 170 to suddenly detect an increased distance to web 200 since it is no longer aiming directly at the meniscus of slack loop 230. The control processor misinterprets such information from acoustic proximity sensor 170 as a suddenly decreased size of slack loop 230, and then quickly decreases the speed of motor 208. When that happens, the meniscus suddenly moves back to its normal position shown in FIG. 1. The control processor then misinterprets the suddenly decreased distance between the meniscus of slack loop 230 and proximity sensor 170 as a suddenly increased size of slack loop 230, and again speeds up motor 208. This cycling can continue with inappropriate jerking on slack loop 230 and hence variation in line movement of web 200 past print head 90.

Rectangular baffle 110, positioned as shown in FIG. 1 and described above, helps to reduce such cycling by restraining movement of the slack loop 230 and its meniscus, in the direction 300. Thus, a required speeding up of motor 208 by control processor does not cause undue movement of the meniscus of slack loop 230 as described, and the above undesirable cycle is inhibited. The positioning of baffle 110 is taken advantage of in an additional way. In particular, it is often desirable to print customer or other information on the back side (that is, the non-imaging side) of web 200. To accomplish this, it has been known to use a printer. However, print heads generally require the web not to move away or toward the print head or there will be distortion of the printing. In the present case, a secondary print head 100 for printing any desired information on the back of web 200 is provided opposite baffle 110 with web 200 passing between them. In this manner, not only does baffle 110 serve to restrain movement of the meniscus of slack loop 230 as described above, but also serves to restrain movement of web 200 away from secondary print head 100 during printing.

It should be noted that the width of a line actually printed by print head 90 need not be identical to the line distance by which web 200 is advanced by print head 90. The two may be the same or different. For example, where print head 90 has a laser beam of width "w" but some degree of overlap of lines printed on web 200 is desired, web 200 may be advanced past print head 90 some line distance less than w.

Variations to the embodiments described above, are of course possible. For example, the slack loop station forming first slack loop 210 could be eliminated if punch 60 was eliminated or replaced by some other marking means which did not cause periodic halting of web movement. Acoustic proximity sensors could be replaced by some other proximity sensor such as a light beam with appropriate electronics. However, for a photosensitive web 200 the light beam should have to have an intensity and/or wavelength which will not unduly expose the photosensitive front layer of web 200. Furthermore, a print head other than laser print head 90 could be used. For example, some other line by line print station can be provided such as an ink jet print station (in which case print head 90 would be replaced by an ink jet print head).

The invention has been described in detail with particular reference to certain preferred embodiments thereof, but it will be understood that other variations and modifications can be effected within the spirit and scope of the invention.

PARTS LIST

10 printer
20,30 cassette
22,32 roll
24,46,76,208 motor
40,70 feeder
42,44,124 idler rollers
50,120 receiver
52 guide plate
54 rollers
60 code punch
72 cylindrical roller
74 rollers
80 platen
90,100 print head
110 baffle
122 guide plate
150,160,170 sensor
200 web
210,220,230,236 loop
212,232 lines
234 surface

What is claimed is:

1. A printer to print images on a continuous web having:

(a) a print station at which the images are printed on the web; and (b) a web transport to transport the web in a lengthwise direction through the print station, the web transport including a slack loop station having:

(i) a web feeder and a web receiver, spaced apart from one another to transport the web in the lengthwise direction while establishing a slack loop therebetween in the web which extends in a first direction; and (ii) a web proximity sensor which is directed along the first direction to measure a distance between the sensor and the slack loop;

wherein:

the slack loop station additionally comprises a baffle oriented in the first direction so as to restrain movement of a meniscus of the slack loop in a direction tangential to the meniscus; and the printer additionally comprises a secondary print head positioned opposite the baffle so as to print on a back side of the web as it passes between the secondary print head and the baffle.

2. A printer according to claim 1 wherein the web proximity sensor comprises an acoustic sensor.

3. A printer according to claim 1 wherein the web proximity sensor is located below a lower end of the slack loop and directs a beam back along the first direction.

4. A printer according to claim 1 wherein the web feeder and the web receiver establish the slack loop which extends downward during normal operation of the printer, and wherein the web proximity sensor is directed upward.

5. A printer according to claim 1 wherein the baffle is positioned adjacent an inside surface of the slack loop.

6. A printer according to claim 1 wherein the baffle is positioned on a feeder side of the slack loop.

7. A printer according to claim 1 wherein the web proximity sensor provides a control signal indicative of a size of the slack loop to a control arrangement which maintains the size of the slack loop substantially constant at respective predetermined values.

8. A printer according to claim 7 comprising a plurality of said slack loop stations which respectively provide for a plurality of said slack loops, a first one of said slack loops being located adjacent to an entrance of said printer and being controlled to have a first predetermined size within a first predetermined range, a second one of said slack loops being located downstream of said first one of said slack loops and upstream of said print station with respect to said lengthwise direction, said second one of said slack loops being controlled to have a second predetermined size within a second predetermined range which are respectively smaller than said first predetermined size and range, and a third one of said slack loops being located downstream of said print station with respect to said lengthwise direction, said third one of said slack loops having a third predetermined size within a third predetermined range which are respectively smaller than said second predetermined size and range.

9. A printer to print images on a continuous web having:

(a) a print station at which the images are printed on the web, the print station having a print head to write the image line by line on the web at a printing position; and (b) first and second web transports to transport the web in a lengthwise direction through the print station in synchronization with line printing by the print head, the first web transport including a first slack loop station on an input side of the print head, and the second web transport including a second slack loop station on an output side of the print head, each of said first and second web transports having:

(i) a web feeder and a web receiver, spaced apart from one another to transport the web in the lengthwise direction while establishing a slack loop therebetween in the web in each of said slack loop stations, said slack loops extending in a first direction; and (ii) a web proximity sensor which is directed along the first direction to measure a distance between the web proximity sensor and the slack loop in each of said slack loop stations, such that a size of each of said slack loops is kept constant based on a measurement from said web proximity sensor so that a total force exerted on the web at the print head by each of said slack loops is substantially equal.

10. A printer according to claim 9 wherein the web proximity sensor comprises an acoustic sensor.

11. A printer according to claim 9 wherein the web proximity sensor is located below a lower end of each of the slack loops and directs a beam back along the first direction.

12. A printer according to claim 9 wherein the web feeder and the web receiver of said first and second web transports establish the slack loop which extends downward during normal operation of the printer, and wherein the web proximity sensor is directed upward.

13. A printer according to claim 9, wherein the web proximity sensor provides the control signal indicative of each of a size of the slack loop to a control arrangement which maintains the size of each of the slack loops substantially constant at respective predetermined values.

14. A printer to print images on a continuous web having:

(a) a print station at which the images are printed on the web, the print station having:

(i) a print platen; and (ii) a print head to write the image line by line on the web at a printing position on the print platen;

(b) a web transport to transport the web in a lengthwise direction through the print station in synchronization with line printing by the print head, the web transport including a first slack loop station on an input side and a second slack loop station on an output side of the print station, the first and second slack loop stations each having:

(i) a web feeder and a web receiver, spaced apart from one another to transport the web in the lengthwise direction while establishing a slack loop therebetween in each of said first and second slack loop stations which extends in a first direction; and (ii) a web proximity sensor which is directed along the first direction to measure a distance between the web proximity sensor and the slack loop;

wherein the print platen acts as the web receiver for the first slack loop station on the input side of the print station, and acts as the web feeder for the second slack loop station on the output side of the print station;

wherein the second slack loop station additionally has a baffle oriented in the first direction so as to restrain movement of a meniscus of the slack loop in a direction tangential to the meniscus; and the printer additionally comprises a secondary print head positioned opposite the baffle so as to print on a back side of the web as it passes between the secondary print head and the baffle, said baffle restraining movement of the web away from the secondary print head during printing.

15. A printer according to claim 14 wherein the web proximity sensor of each of the first and second slack loop stations comprises an acoustic sensor.

16. A printer according to claim 14 wherein the web proximity sensor of each of the first and second slack loop stations is located below a lower end of the slack loop stations and directs a beam back along the first direction.

17. A printer according to claim 14 wherein the web feeder and the web receiver of each of the first and second slack loop stations establish respective slack loops which extend downward during normal operation of the printer, and wherein the web proximity sensor of each of the first and second slack loop stations is directed upward.

18. A printer according to claim 14 wherein the baffle is positioned adjacent an inside surface of the slack loop.

19. A printer according to claim 18 wherein the baffle is positioned on a feeder side of the slack loop.

20. A printer according to claim 14, wherein the web proximity sensor provides a control signal indicative of a size of each of the slack loops in the first and second slack loop stations to a control arrangement which maintains the size of the slack loop in each of said first and second slack loop stations substantially constant at respective predetermined values.

21. A method of printing images on a continuous web, the method comprising the steps of:

(a) printing the images on the web at a print station; and (b) transporting the web in a lengthwise direction in a web transport path through the print station, while:

(i) forming a slack loop in the web transport path which slack loop extends in a first direction;

(ii) measuring a distance which the slack loop extends in the first direction using a proximity sensor directed along the first direction;

(iii) restraining movement of a meniscus of the slack loop by contacting an inside surface of the slack loop with a baffle; and (iv) printing on a back side of the web as it passes the baffle.

22. A method according to claim 21 wherein the beam is an acoustic or electromagnetic beam.

23. A method according to claim 21 wherein, in the measuring step, a reflection of the beam from a meniscus of the slack loop is detected.

24. A method according to claim 21 wherein the beam is an acoustic beam.

25. A method according to claim 21 wherein the beam is provided from below a lower end of the slack loop and is directed back along the first direction.

26. A method according to claim 21 wherein the slack loop extends downward, and wherein the beam is directed upward.

27. A method according to claim 21 wherein the slack loop is contacted with the baffle positioned adjacent a feeder side of the slack loop.

28. A method according to claim 21, comprising the further step:

providing a signal to a control assembly indicative of a size of the slack loop based on said measured distance; and maintaining the size of said slack loop substantially constant at respective predetermined values.

29. A method of printing images on a continuous web, the method comprising the steps of:

(a) printing the images on the web at a print station, including:

(i) passing the web over a print platen;

(ii) writing each image line by line on the web at a printing position on the print platen; and (b) transporting the web in a lengthwise direction through the print station in synchronization with line printing, while:

(i) forming a slack loop on each side of the print platen which slack loops both extend in a first direction;

(ii) measuring the distance which each slack loop extends in the first direction using a proximity sensor directed along the first direction; and (iii) maintaining a size of each slack loop constant based on said measuring step so that a total force exerted on the web at said print platen by each of said slack loops is substantially equal.

30. A method according to claim 29 wherein the proximity sensor comprises an acoustic beam.

31. A method according to claim 29, comprising the further step:

providing a signal to the control assembly indicative of each of a size of the slack loops based on said measured distance; and maintaining the size of each of said slack loops substantially constant at respective predetermined values.

32. A printer to print images on a continuous web having:

(a) a print station at which the images are printed on the web;

(b) a web transport to transport the web in a lengthwise direction through the print station, the web transport including a plurality of slack loop stations each slack loop station having:

(i) a web feeder and a web receiver, spaced apart from one another to transport the web in the lengthwise direction while establishing a slack loop therebetween in the web which extends in a first direction; and (ii) a web proximity sensor which is directed along the first direction to measure a distance between the sensor and the slack loop; and (c) said plurality of slack loop stations which respectively provide for a plurality of slack loops, a first one of said slack loops being located adjacent to an entrance of said printer and being controlled to have a first predetermined size within a first predetermined range, a second one of said slack loops being located downstream of said first one of said slack loops and upstream of a print head of said print station with respect to said lengthwise direction, said second one of said slack loops being controlled to have a second predetermined size within a second predetermined range which are respectively smaller than said first predetermined size and range, and a third one of said slack loops being located downstream of said print head of said print station with respect to said lengthwise direction, said third one of said slack loops having a third predetermined size within a third predetermined range which are respectively smaller than said second predetermined size and range, such that a total force exerted by each of said second one of said slack loops and said third one of said slack loops on the web at said print head is substantially equal.

* * * * *